US006135614A

United States Patent [19]

Chen

[11] Patent Number: 6,135,614

[45] Date of Patent: Oct. 24, 2000

[54] LAMP HOLDER FOR THREE-WIRE CHRISTMAS FLASHING CONTROL LAMP

[76] Inventor: Johnny Chen, No. 2, Alley 2, Lane 626, Chung Chen Ld., Hsinchu City, Taiwan

[21] Appl. No.: 09/175,993

[22] Filed: Oct. 21, 1998

[51] Int. Cl.[7] ..... H01R 33/00; F21K 2/00

[52] U.S. Cl. ..... 362/226; 362/211

[58] Field of Search ..... 362/226, 211, 362/227; 313/300, 303

[56] References Cited

U.S. PATENT DOCUMENTS

| | | | |
|---|---|---|---|
| 4,593,232 | 6/1986 | McEdwards | 315/199 |
| 5,137,465 | 8/1992 | Chwang | 439/356 |

*Primary Examiner*—Cassandra Spyrou
*Assistant Examiner*—Jared Treas
*Attorney, Agent, or Firm*—Dougherty & Troxell

[57] ABSTRACT

A lamp holder for three-wire Christmas flashing control lamp is disclosed. The flashing control lamp is provided with three conductive wires, in which three conductive wires extend from a lower end of a lamp base, and then the lamp base is mounted in a fitting hole of the lamp holder. Three metal plates are disposed in the fitting hole corresponding to the three conductive wires. The outer wall face of the lamp base and the inner wall face of the fitting hole are respectively formed with a rib and a guide channel corresponding to each other. When the lamp base is fitted into the lamp holder, the rib is slided along the guide channel so as to make sure that the three conductive wires respectively contact with the three metal plates at correct leg positions to conduct electricity.

3 Claims, 5 Drawing Sheets

LAMP HOLDER FOR THREE-WIRE CHRISTMAS FLASHING CONTROL LAMP

BACKGROUND OF THE INVENTION

1. Field of the Invention

The present invention relates to a lamp holder structure for Christmas lamp, and more particularly to a lamp holder structure for three-wire Christmas flashing control lamp, in which when the lamp base of the flashing control lamp is fitted into the lamp holder, three conductive wires of the lamp base are accurately in contact with three metal plates disposed in the lamp holder at correct leg positions.

2. Description of the Prior Art

In general, the Christmas light bulbs are serially connected with each other to form a decorative light string which is suitable to be hung on a tree, a fence, a roof, etc. as a decoration. Typically, the light string includes a flashing control lamp as a control unit for controlling the flickering of the light string.

The conventional lamp holder for the Christmas flashing control lamp includes a lamp holder and a lamp base connected with a flashing control lamp. The flashing control lamp has two conductive wires extending out of the lamp base and positioned opposite to each other at 180 degree intervals. The lamp base is fitted in the lamp holder with the conductive wires in contact with two metal plates disposed in the lamp holder for conducting electricity.

In such lamp base structure, the opposite outer side walls are formed as plane faces and the two conductive wires respectively extend on the plane faces.

The inner wall of the fitting hole of the lamp holder is correspondingly formed with two plane faces on which the two metal plates are disposed. When the lamp base is fitted into the fitting hole of the lamp holder, the two conductive wires are right in contact with the metal plates.

When the above two-wire Christmas flashing control lamp is used to control a light string, the light string can only create a monotonous flashing effect without various flickering patterns. Therefore, it is necessary to provide a three-wire Christmas flashing control lamp which has contact switching function so that the light string can achieve a various flickering effect.

In the three-wire Christmas flashing control lamp structure, it is important to locate the three conductive wires at correct leg positions so as to achieve the expected flickering effect. In case the three conductive wires are incorrectly located, it will be impossible to achieve the flickering function and even a short circuit may take place in the light string circuit. Therefore, when the lamp base is assembled with the lamp holder, the three conductive wires of the flashing control lamp must contact with the three metal plates disposed in the lamp holder at correct leg positions to conduct electricity.

SUMMARY OF THE INVENTION

It is therefore a primary object of the present invention to provide a lamp holder structure for three-wire Christmas flashing control lamp, in which when the lamp base of the flashing control lamp is fitted into the lamp holder, it is ensured that three conductive wires of the lamp base are accurately in contact with three metal plates disposed in the lamp holder at correct leg positions.

According to the above object, the outer wall face of the lamp base and the inner wall face of the fitting hole are respectively formed with a rib and a guide channel corresponding to each other. When the lamp base is fitted into the lamp holder, the rib is slided along the guide channel so as to make sure that the three conductive wires respectively contact with the three metal plates at correct leg positions to conduct electricity.

The present invention can be best understood through the following description and accompanying drawings, wherein:

DETAILED DESCRIPTION OF THE PREFERRED EMBODIMENTS

Figure 1:
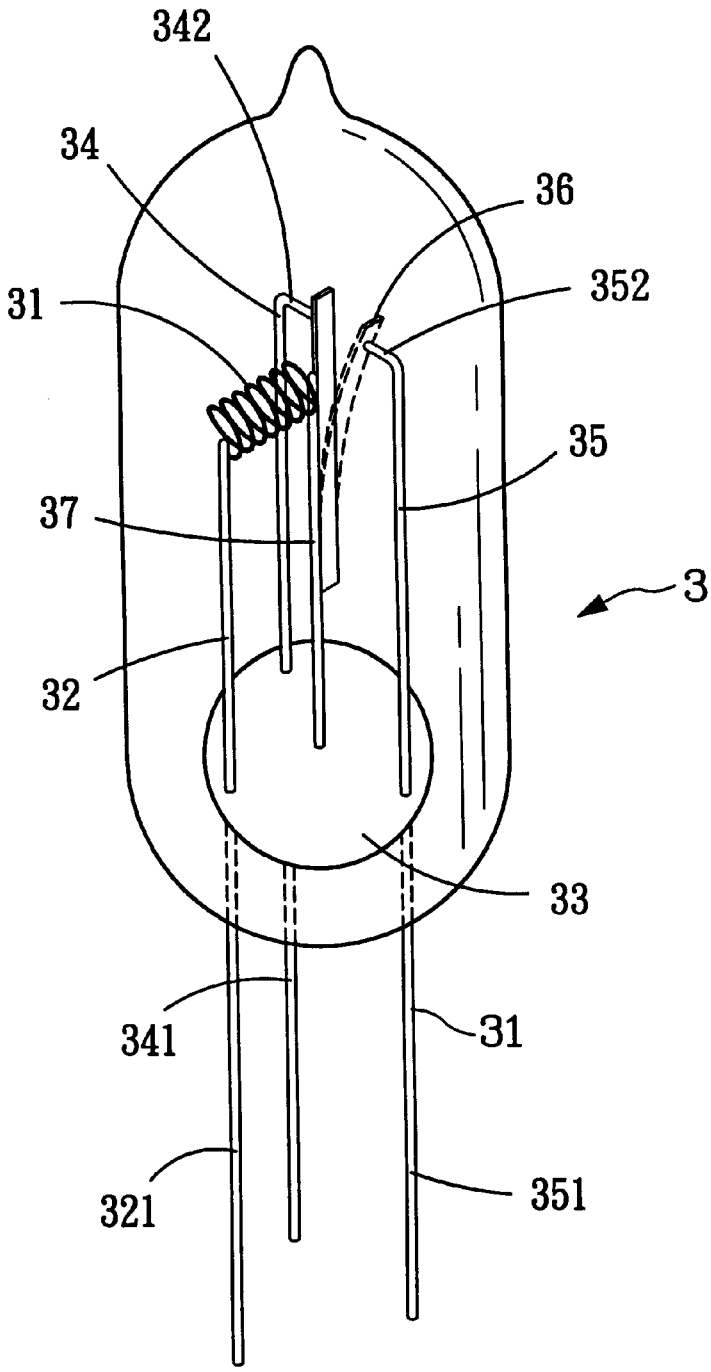
FIG. 1 is a perspective view of the three-wire Christmas flashing control lamp structure of the present invention.

Please refer to FIG. 1. The three-wire Christmas flashing control lamp 3 includes therein a first, a second and a third conductive poles 32, 34, 35. Two ends of a filament are respectively connected to the first conductive pole 32 and a central pole 37 which is soldered with a bimetal plate 36 having a free end.

The first, second and third conductive poles 32, 34, 35 and the central pole 37 are fixed by a glass positioning ball 33 and connected with a first, a second and a third conductive wires 321, 341, 351 extending from the ball member 33 out of a lower end of the bulb 3.

In a powered off state, the bimetal plate 36 contacts with the second conductive pole 34. When the first and second conductive wires 321, 341 are electrically connected to the power source, the flashing control lamp 3 is lighted to generate heat therein. After a predetermined period of time, the bimetal plate 36 is subject to heat and curved to separate from the second conductive pole 34 and contact with the third conductive pole 35. When the first and second conductive wires 321, 341 are no more electrically connected to the power source, the bimetal plate 36 is cooled and restored to its home position to contact with the second conductive pole 34. Therefore, by means of the flashing control lamp and the design of the circuit, the light string can flicker.

Figure 2:
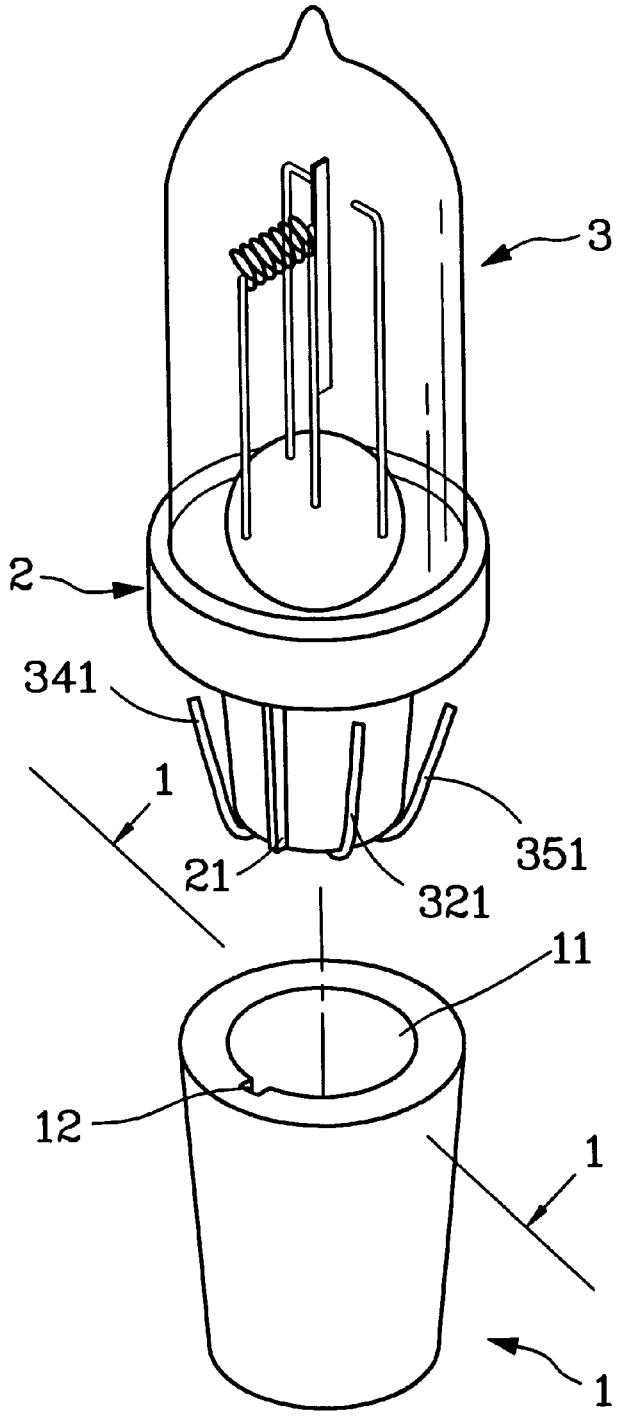
FIG. 2 is a perspective exploded view of the lamp holder and the flashing control lamp of the present invention.
Figure 3:
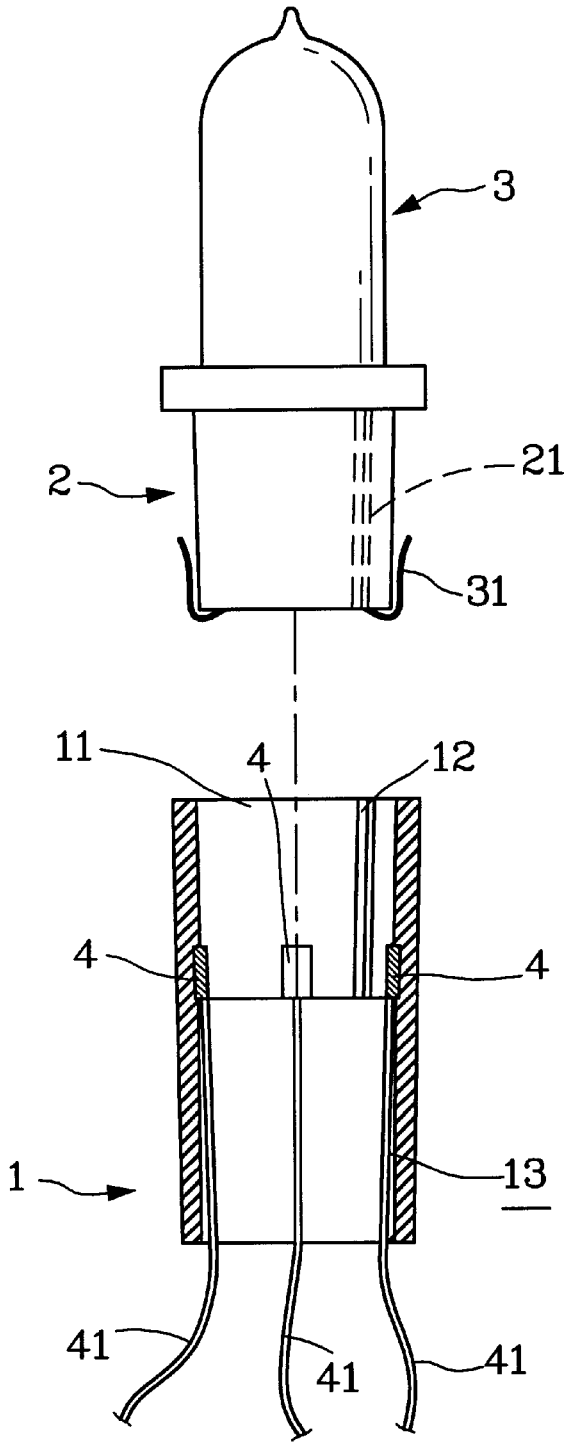
FIG. 3 is a sectional view taken along line A—A of FIG. 2, showing the connection relationship between the lamp holder and the flashing control lamp of the present invention.

Moreover, the three conductive wires of the lamp enable the light string to flicker with more various patterns. Referring to FIGS. 2 and 3, the flashing control lamp 3 is first fitted into a lamp base 2. The base section of the lamp base 2 is formed with three orifices ( not shown ) at 120 degree intervals. The first, second and third conductive wires 321, 341, 351 are respectively passed through the orifices and then upward bent to attach to the outer wall face of the lamp base 2. The outer wall face of the lamp base 2 is formed with an axial rib 21.

Figure 4:
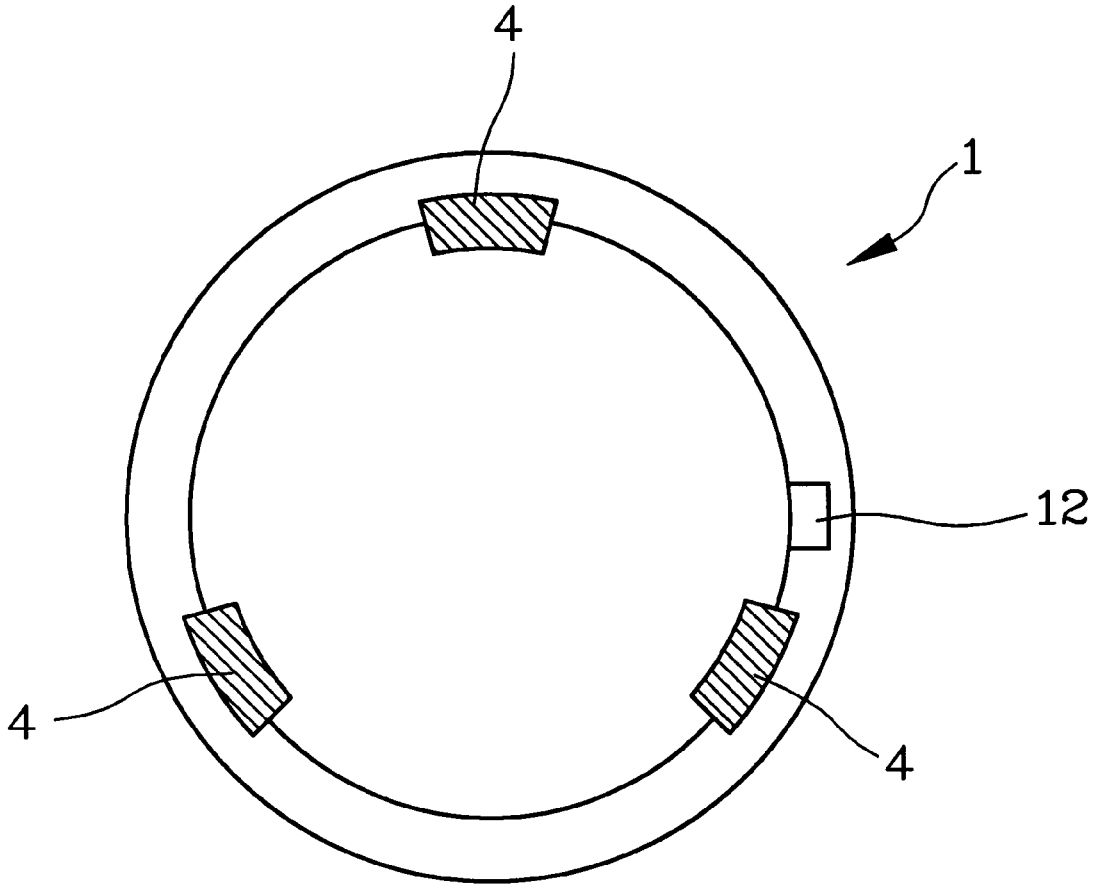
FIG. 4 is a top plane view of the lamp holder according to FIG. 2.

Referring to FIGS. 2 to 4, the lamp base 2 is fitted into a fitting hole 11 of the lamp holder 1. The bottom wall of the fitting hole 11 is formed with three through holes 13 at 120 degree intervals ( referring to FIG. 4 ). Three metal plates 4 are embedded in the inner wall of the fitting hole 11 at the through holes 13 corresponding to the first, second and third conductive wires 321, 341, 351. Each metal plate 4 is connected with a conductive wire 41 passing through the through hole 13. Accordingly, when the lamp base 2 is fitted into the fitting hole 11, the first, second and third conductive wires 321, 341, 351 contact with the three metal plates 4 to conduct electricity.

The flashing control lamp 3 of the present invention has three lines the legs of which should be correctly connected to the circuit so as to make the light string normally function. Therefore, the inner wall face of the fitting hole 11 is formed with a guide channel 12 corresponding to the rib 21 serving as a locating structure. When assembling the lamp base 2 with the lamp holder 1, the rib 21 is slided along the guide channel 12 to fit the lamp base 2 into the lamp holder 1. Accordingly, the legs are prevented from being located at incorrect positions and it is ensured that the first, second and third conductive wires 321, 341, 351 of the bulb 3 are respectively in contact with the three metal plates 4 to conduct electricity.

Figure 5:
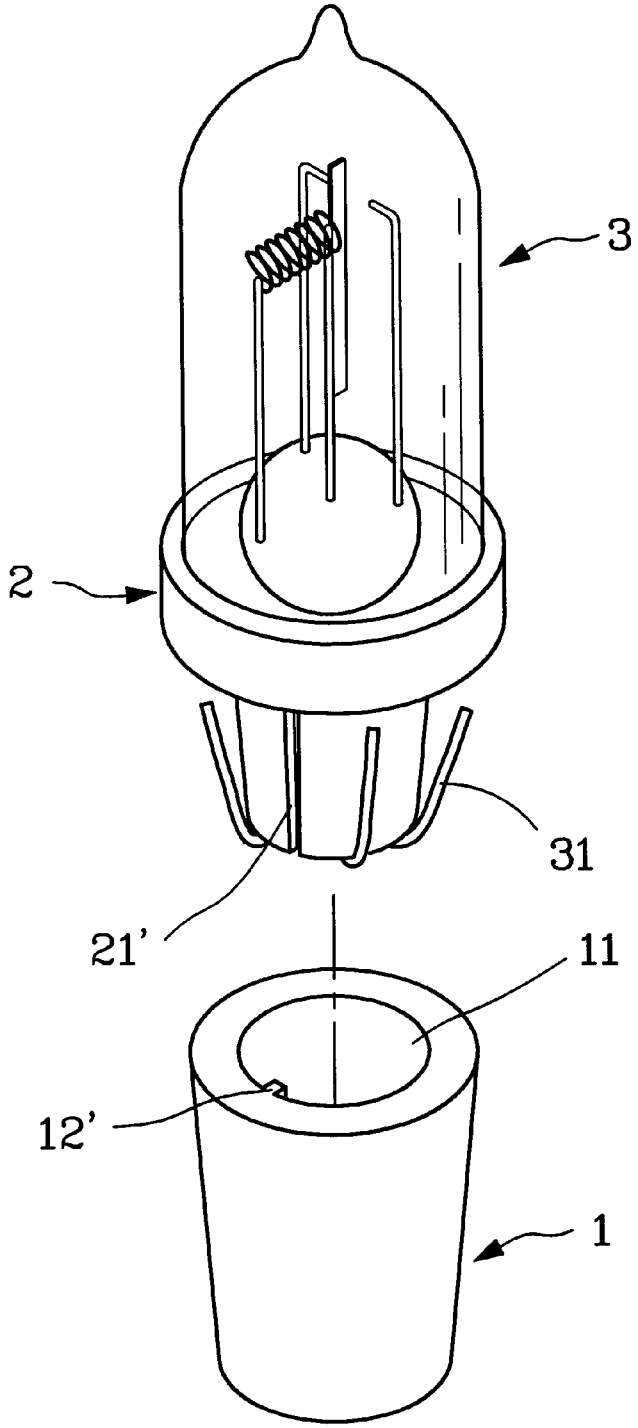
FIG. 5 shows another embodiment of the present invention, in which the lamp base of the flashing control lamp is formed with a guide channel and the lamp holder is formed with a rib corresponding to the guide channel.

FIG. 5 shows another embodiment of the present invention, in which the positions of the rib 21 of the lamp base 2 and the guide channel 12 of the lamp holder 1 are exchanged. That is, the inner wall face of the fitting hole 11 of the lamp holder 1 is formed with a rib 12', while the outer side wall of the lamp base 2 is correspondingly formed with a guide channel 21'. By means of the structures of the guide channel 21' and the rib 12', the lamp base can be assembled with the lamp holder with the legs inserted in a correct position.

It is to be understood that the above description and drawings are only used for illustrating some embodiments of the present invention, not intended to limit the scope thereof. Any variation and derivation from the above description and drawings should be included in the scope of the present invention.

What is claimed is:

1. A lamp holder for three-wire Christmas flashing control lamp, comprising:

a lamp base for fitting with the flashing control lamp, three conductive wires of the flashing control lamp extending out of a lower end of the lamp base;

a lamp holder having a fitting hole in which the lamp base is mounted, an inner wall of the fitting hole having three metal plates arranged on the inner wall of the fitting hole at 120 degree intervals, corresponding to the three conductive wires of the flashing control lamp; and a locating structure, when the lamp base is fitted into the fitting hole of the lamp holder, the three conductive wires of the flashing control lamp are respectively in contact with the three metal plates of the lamp holder at predetermined leg positions.

2. The lamp holder as claimed in claim 1, wherein the locating structure comprises a guide channel formed in an outer wall face of the lamp base and a rib formed on an inner wall face of the lamp holder corresponding to the guide channel.

3. The lamp holder as claimed in claim 1, wherein the locating structure comprises a rib formed on an outer wall face of the lamp base and a guide channel formed in an inner wall face of the lamp holder corresponding to the rib.

* * * * *